United States Patent [19]

Hoffmann et al.

[11] Patent Number: 4,556,621

[45] Date of Patent: Dec. 3, 1985

[54] ELECTROPHOTOGRAPHIC RECORDING MATERIAL CONTAINING A METAL-1,3-DIKETONE COMPLEX

[75] Inventors: Gerhard Hoffmann, Otterstadt; Peter Neumann, Wiesloch, both of Fed. Rep. of Germany

[73] Assignee: BASF Aktiengesellschaft, Fed. Rep. of Germany

[21] Appl. No.: 625,970

[22] Filed: Jun. 29, 1984

[30] Foreign Application Priority Data

Jul. 5, 1983 [DE] Fed. Rep. of Germany ..... 3324089

[51] Int. Cl.[4] ..... G03G 5/04; G03G 13/28

[52] U.S. Cl. ..... 430/49; 430/58; 430/83; 430/96

[58] Field of Search ..... 430/58, 57, 49, 83, 430/96

[56] References Cited

U.S. PATENT DOCUMENTS

| | | | |
|---|---|---|---|
| 3,037,861 | 6/1968 | Hoegl et al. . | |
| 3,553,009 | 1/1971 | Hoegl et al. | 117/201 |
| 3,615,385 | 10/1971 | Lind | 96/1 |
| 3,620,723 | 11/1971 | Yamaguchi et al. | 96/1.5 |
| 3,839,034 | 10/1974 | Wiedemann | 96/1.5 |
| 3,973,959 | 8/1976 | Rochlitz et al. | 96/1.5 |
| 3,997,342 | 12/1976 | Bailey | 430/58 |
| 4,315,981 | 2/1982 | Wiedemann | 430/59 |

FOREIGN PATENT DOCUMENTS

| | | |
|---|---|---|
| 1058836 | 6/1956 | Fed. Rep. of Germany . |
| 1117391 | 5/1962 | Fed. Rep. of Germany . |
| 1120875 | 7/1962 | Fed. Rep. of Germany . |
| 2625116 | 3/1980 | Fed. Rep. of Germany . |

*Primary Examiner*—John L. Goodrow

*Attorney, Agent, or Firm*—Keil & Weinkauf

[57] ABSTRACT

Electrophotographic recording materials which comprise an electrically conductive base, charge carrier-producing compounds or sensitizers, charge carrier-transporting compounds and added metal-1,3-diketone complexes and possess high photosensitivity and low conductivity in the dark are used for reprographic purposes and for the production of electrophotographic printing plates, in particular offset printing plates.

10 Claims, No Drawings

ELECTROPHOTOGRAPHIC RECORDING MATERIAL CONTAINING A METAL-1,3-DIKETONE COMPLEX

The present invention relates to electrophotographic recording materials which comprise an electrically conductive base, charge carrier-producing compounds or sensitizers, charge carrier-transporting compounds and special additives.

Electrophotographic processes, materials required for these, and various embodiments of the composition of recording materials have been disclosed. Advantageous materials for use in the reprography sector are those comprising a polymeric binder which can be adapted to the special requirements of the particular field of use, low molecular weight organic compounds which are soluble, even in high concentration, in the binder and are capable of transporting charge carriers, and compounds, in particular dyes or pigments, which produce charge carriers when exposed imagewise to actinic light, and are capable of transferring these charge carriers to the charge-transporting compounds, with the aid of the electric field exerted from outside by the electrostatic surface charge. Depending on the field of use of the recording material, these charge carrier-producing compounds can be incorporated, as a separate layer, in a composite structure (cf. German Laid-Open Application DOS No. 2,220,408), or may be present in the form of a monodisperse solution of the dye molecules in a mixture of the binder and the charge carrier-transporting compounds (cf. German Pat. No. 1,058,836). The multi-layer electrophotographic recording material described in German Laid-Open Application DOS No. 2,220,408 comprises an electrically conductive base, a first layer which is about 0.005–2 μm thick, contains a dye and produces charge carriers when exposed to actinic light, and a second layer which is composed of organic materials, which are insulating in the dark, together with one or more charge-transporting compounds.

It has also been disclosed that photosemiconducting organic compounds may be used for the production of electrophotographic printing plates, in particular electrophotographic offset printing plates (cf. German Pat. Nos. 1,117,391 and 1,120,875 and German Published Applications DAS No. 1,522,497 and DAS No. 2,726,116).

The increased demands on reprographic systems necessitate a large variety of recording materials and systems in order that special problems can be solved in an optimum manner. The characteristics desired include good resolution and good toning properties. Inadequate toning, which is a frequent cause for complaint and which indicates unfavorable differentiation between the field strengths of the exposed and non-exposed areas, is often attributable to the fact that the recording material in the charged state possesses an excessively high conductivity in the dark, so that there is an inadequate surface charge density before imagewise exposure to actinic light.

High photosensitivity is very particularly desirable since this enables the process times required to be reduced. The necessary exposure time plays an important role particularly in the production of electrophotographic offset printing plates. In this connection, however, the existing systems are frequently criticized.

It is an object of the present invention to provide electrophotographic recording materials which are suitable, in particular, for the production of electrophotographic printing plates, such as offset printing plates, and which possess improved photosensitivity coupled with low conductivity in the dark and good resolution.

We have found that this object is achieved, and that electrophotographic recording materials which comprise an electrically conductive base, charge carrier-producing compounds or sensitizers, charge carrier-transporting compounds, binders and additives and which are improved in the above respects are obtained, if the recording materials contain, as additives, from 0.5 to 30, preferably from 3 to 15, % by weight, based on the amount of binder in the layer containing charge carrier-transporting compounds, of a metal-1,3-diketone complex.

Particularly suitable metal-1,3-diketone complexes are those of the formula (I)

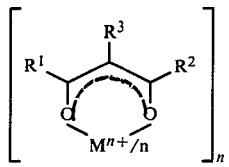

(I)

where $R^1$ and $R^2$ can be identical or different and are each unsubstituted or substituted alkyl, in particular unsubstituted or fluorine-substituted alkyl, unsubstituted or substituted cycloalkyl, in particular the 5-membered or 6-membered alkyl-substituted cycloalkyl radical, unsubstituted or substituted phenyl, naphthyl or biphenyl, or a 5-membered or 6-membered heterocyclic radical, in particular an unsaturated one, $R^3$ is hydrogen or unsubstituted or substituted alkyl or phenyl, M is an element of atomic number 21 (scandium), 39 (yttrium) or 57–71, and n is 3 or, where M is cerium (atomic number 58), is furthermore 4.

Other very suitable metal-1,3-diketone complexes are those of the formula (II)

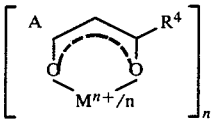

(II)

where A is a saturated, unsubstituted or substituted 5-membered or 6-membered carbon ring, in particular one which is substituted by alkyl or bridged by alkylene, $R^4$ is unsubstituted or substituted alkyl, in particular fluorine-substituted alkyl, or cycloalkyl which is substituted, in particular by alkyl, in particular a 5-membered or 6-membered cycloalkyl radical, and M and n have the meanings given above for formula (I).

Preferred compounds of the formula (I) are those where $R^1$ and $R^2$ can be identical or different and are each a linear or branched alkyl radical of 1 to 4 carbon atoms, a linear perfluoroalkyl radical of 1, 2 or 3 carbon atoms, cyclopentyl, cyclohexyl, campholyl, fencholyl, or phenyl which is substituted by one or two halogen atoms or one or two methyl or methoxy groups, or are each furyl, thienyl or pyridyl, $R^3$ is hydrogen, M is scandium, yttrium, lanthanum, cerium, praseodymium, neodymium, europium, dysprosium, holmium or ytterbium, and n is 3 or, where M is cerium, may furthermore be 4.

Preferred compounds of the formula (II) are those of the formula (IIa)

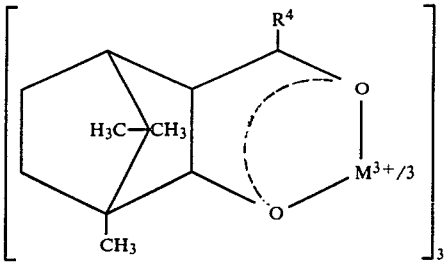

(IIa)

where $R^4$ is a linear or branched alkyl radical of 1 to 4 carbon atoms or a perfluoroalkyl radical of 1 to 3 carbon atoms, and M is europium.

Particularly preferred compounds of the formula (I) are those in which $R^1$ and $R^2$ can be identical or different and are each methyl, ethyl, isopropyl, tert.-butyl, trifluoromethyl, heptafluoropropyl or phenyl, $R^3$ is hydrogen, M is lanthanum, cerium, praseodymium, neodymium, europium, dysprosium, holmium or ytterbium, and n is 3.

Compounds of the formula (I), where $R^1$ and $R^2$ can be identical or different and are each methyl, trifluoromethyl or tert.-butyl, $R^3$ is hydrogen, M is praseodymium or europium and n is 3, have proven particularly useful.

Examples of 1,3-diketones which are capable of forming complexes, in particular those of the formulae (I) and (II), with the metals are pentane-2,4-dione, 1,1,1-trifluoropentane-2,4-dione, 1,1,1,5,5,5-hexafluoropentane-2,4-dione, hexane-2,4-dione, 2-methylhexane-2,4-dione, 5,5-dimethylhexane-2,4-dione, 1,1,1-trifluorohexane-2,4-dione, 1,1,1-trifluoro-5-methylhexane-2,4-dione, 1,1,1-trifluoro-5,5-dimethylhexane-2,4-dione, 1,1,1,5,5,6,6,7,7,7-decafluoroheptane-2,4-dione, heptane-3,5-dione, 2,2,6-trimethylheptane-3,5-dione, 2,2,6,6-tetramethylheptane-3,5-dione, 6,6,7,7,8,8,8-heptafluoro-2,2-dimethyloctane-3,5-dione, decane-2,4-dione, heneicosane-2,4-dione, 1-phenylbutane-1,3-dione, 4,4,4-trifluoro-1-phenylbutane-1,3-dione, 4,4,4-trifluoro-1-(4-methylphenyl)-butane-1,3-dione, 4,4,4-trifluoro-1-(4-methoxyphenyl)-butane-1,3-dione, 4,4,4-trifluoro-1-(4-fluorophenyl)-butane-1,3-dione, 1-(2-naphthyl)-butane-1,3-dione, 1,3-diphenylpropane-1,3-dione, 1,3-bis-(4-pyridyl)-propane-1,3-dione, 4,4,4-trifluoro-1-(2-furyl)-butane-1,3-dione, 4,4,4-trifluoro-1-(2-thienyl)-butane-1,3-dione, 1,3-bis-(2-thienyl)-propane-1,3-dione,

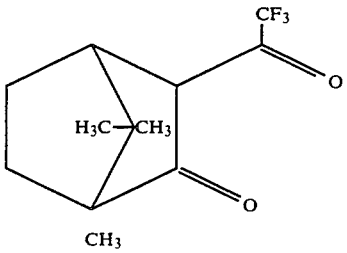

-continued

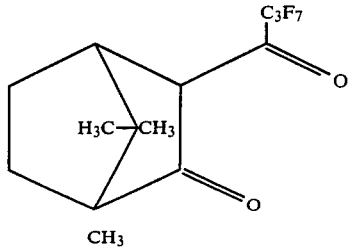

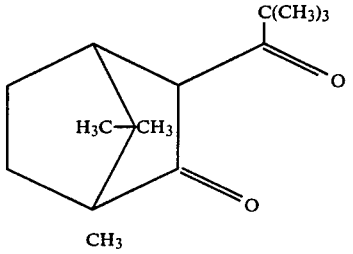

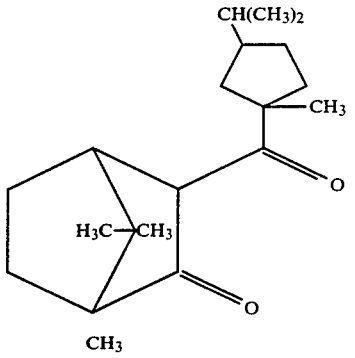

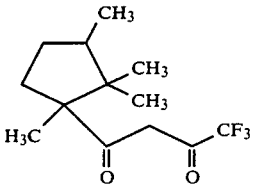

The compounds used according to the invention are known. Those which are unknown can be prepared by a conventional method, for example by the methods described in Gmelin Handbuch der Anorganischen Chemie, Syst. No. 39 Rare Earths, vol. D 3, 8th edition 1981, page 65 et seq.

Very particularly surprising is the fact that the addition, according to the invention, of the metal-1,3-diketone complexes greatly improves the photosensitivity and at the same time substantially increases the maximum potential acceptance of the electrophotographic recording materials without modifying the characteristics in the dark; consequently, the improvement in the photosensitivity is also accompanied by an improvement in the differentiation between exposed and unexposed areas of the charged surface.

The skilled worker is familiar with the fact that even small amounts of metal halides, eg. zinc chloride, magnesium bromide or aluminum chloride, and ketones, eg. acetophenone, benzophenone or benzil, are capable of improving the photosensitivity of certain organic photosemiconductor layers (eg. U.S. Pat. Nos. 3,037,861, 3,553,009 and 3,620,723). It has also been confirmed that the addition of metal halides and ketones does not produce the novel effects. The effect achieved according to the invention by the metal-1,3-diketone complexes cannot be derived by the skilled worker on the basis of the conventional additives.

The metal-1,3-diketone complexes which are used according to the invention and improve the photosensitivity can advantageously be used in both single-layer and multi-layer recording systems applied on an electrically conductive base.

Suitable single-layer systems comprise, preferably on a conductive base, a layer of (a) from 45 to 75 parts by weight of a binder, (b) from 30 to 60, in particular from 35 to 50, parts by weight of a charge carrier-transporting compound, (c) if appropriate from 5 to 25 parts by weight of another, essentially inactive binder, (d) from 0.05 to 0.8 part by weight of a compound which produces charge carriers when exposed to actinic light, in particular a suitable dye, and (e) from 0.5 to 30, in particular from 3 to 15, % by weight, based on the amount of binder, of one or more of the metal-1,3-diketone complexes according to the invention. The layer is advantageously applied from about 5% strength by weight solution in a suitable organic solvent onto the clean conductive base so as to give a layer which is about 0.8–40 μm thick after the solvent has been evaporated off in the air. The thickness of the layer depends on the intended use, and is, in particular, from 0.8 to 6 μm in the case of electrophotographic printing plates.

Suitable multi-layer systems advantageously possess, on an electrically conductive base, (a) a layer containing charge carrier-producing compounds and (b) a further layer containing (b1) one or more charge carrier-transporting compounds, (b2) one or more organic binders and (b3) if required, further additives which improve, in particular, the mechanical properties of the layer. The layer (b) contains from 0.5 to 30, preferably from 3 to 15, % by weight, based on the amount of binder, of one or more of the metal-1,3-diketone complexes according to the invention, and advantageously contains from 30 to 60 parts by weight of (b1), from 45 to 75 parts by weight of (b2) and, if required, from 5 to 25 parts by weight of the additives (b3).

The first layer is advantageously applied onto the base in a thickness of from 0.005 to 5, in particular from 0.1 to 0.9, μm, from solution in a suitable solvent. After this layer has been applied, the second layer is advantageously applied so that a layer from 5 to 25, in particular from 7 to 15, μm thick results after the composite structure has been dried.

In principle, any electrically conductive base can be employed, provided that it is suitable for the field of use of the recording material. Depending on the field of use, preferred bases are aluminum, zinc, magnesium, copper or polymetallic sheets, for example crude or pretreated, eg. roughened and/or anodized, aluminum sheet, aluminum foils, polymer films with metallized surfaces, such as polyethylene terephthalate films coated with aluminum by vapor deposition, and special electrically conductive papers. Bases for printing plates are advantageously from 0.08 to about 0.3 mm thick.

The use for which the recording material is intended determines which type of organic binder is suitable for the layers. Examples of suitable binders for the copying sector are cellulose ether, polyester resins, polyvinyl chlorides, polycarbonates, copolymers, eg. styrene/-maleic anhydride or vinyl chloride/maleic anhydride copolymers, or mixtures of these. The choice of binders is governed in particular by their film-forming and electrical properties, their adhesion on the base and their solubility properties. Particularly suitable binders for recording materials for the production of electrophotographic printing plates, especially offset printing plates, are those which are soluble in basic aqueous or alcoholic solvents. These are, in particular, substances possessing groups which make them soluble in alkali, eg. anhydride, carboxyl, sulfonic acid, phenol or sulfonimide groups. Preferred binders are those which in particular have a high acid number, and are readily soluble in basic aqueous-alcoholic solvent systems and have a mean weight average molecular weight of from 800 to 150,000, in particular from 1,200 to 80,000. Examples of suitable binders are copolymers of methacrylic acid and methacrylates, in particular those of styrene with maleic anhydride and of styrene, methacrylic acid and methacrylates, provided that they possess the above solubility properties. Although it is known that binders possessing free carboxyl groups cause an undesirable increase in the conductivity of electrophotographic layers in the dark and hence lead to poor toning results, such binders can be readily made compatible with the charge carrier-transporting compounds used. Thus, we have found that styrene/maleic anhydride/acrylic or methacrylic acid copolymers which contain from 5 to 50% by weight of maleic anhydride as copolymerized units and from 5 to 35, in particular from 10 to 30, % by weight of acrylic or methacrylic acid as copolymerized units give satisfactory electrophotographic layers having adequate conductivity in the dark. They are highly soluble in washout solutions containing 75% by weight of water, 23% by weight of isobutanol and 2% by weight of sodium carbonate, but are insoluble in fountain solutions conventionally used for offset plates.

Examples of suitable charge carrier-producing compounds or sensitizers for single-layer systems, as also used for the production of electrophotographic printing plates, are triarylmethane dyes, xanthene dyes and cyanine dyes. Very good results were obtained with rhodamine B (C.I. 45170), rhodamine 6 G (C.I. 45160), malachite green (C.I. 42000), methyl violet (C.I. 42535) and crystal violet (C.I. 42555). In multi-layer systems, the dye or the pigment is present in a separate charge carrier-producing layer. In this case, azo dyes, phthalocyanines, isoindoline dyes and perylenetetracarboxylic acid derivatives are particularly effective. Good results are achieved with perylene-3,4:9,10-tetracarboxylic acid diimide derivatives, as described in German Laid-Open Applications DOS No. 3,110,954 and DOS No. 3,110,960.

Suitable charge carrier-transporting compounds are known to the skilled worker, examples being oxazole derivatives (German Pat. No. 1,120,875), oxadiazole derivatives (German Pat. No. 1,058,836), triazole derivatives (German Pat. No. 1,060,260), azomethines (U.S. Pat. No. 3,041,165), pyrazoline derivatives (German Pat. No. 1,060,714) and imidazole derivatives (German Pat. No. 1,106,599). Benzotriazole derivatives (German Patent Application No. P 32 15 968.4) and hydrazone derivatives (German Patent Application No. P 32 01 202.0) are preferred. The compounds used are generally low molecular weight compounds which, when used in the required amount, are highly compatible with the organic binders. However, it is also possible to use polymeric charge carrier-transporting compounds, eg. poly(N-vinylcarbazole).

Depending on the use to which it is put, the electrophotographic recording material according to the invention can contain conventional additives, for example leveling agents and plasticizers in the photoconductive layer, or adhesion promoters between the base and the layer.

The novel electrophotographic recording materials have a combination of very good properties, in particular high photoconductivity coupled with very low conductivity in the dark, and are hence very useful for the copying sector.

They possess substantial advantages when used for the production of electrophotographic printing plates, satisfying high requirements in respect of resolution and print run. When the plate is processed in a process camera, the high photosensitivity permits the exposure time to be greatly reduced compared with commercial materials. The very crisp image reproduction results in good resolution, and, as a result of high charge contrast, it is also possible to obtain good reproduction of fine dots in the light tonal range. Furthermore, exposure of the layers results in very low residual potentials, and the images obtained during toning are free from ground in the non-image areas.

Electrophotographic offset printing plates are produced in a conventional manner by charging the electrophotographic recording material electrostatically by means of a high-voltage corona, following this directly by imagewise exposure, developing the resulting latent electrostatic charge image by means of a dry or liquid toner, fixing the toner in a downstream melting process and removing the non-toned photosemiconducting layer by means of a suitable washout solvent. The resulting printing plate can then be prepared in a conventional manner for offset printing, this preparation comprising, for example, hydrophilizing and gumming the water-bearing surface.

The Examples which follow illustrate the invention. Parts and percentages are by weight.

The layers are charged uniformly to a surface potential of −600 volt by means of a corona at a direct current voltage of −8.5 kV at a distance of 1 cm, and are then exposed to white light from a high pressure xenon lamp with an illuminating power of 10 $\mu w.cm^{-2}$ in the plane of the layer. The photoinduced decrease in potential during exposure is monitored over the course of time until the surface potential has fallen to below 5% of the initial value. The time during which the surface potential falls to half its value is determined, a correction factor for the decrease in the potential in the dark being applied. The half-value photosensitivity is determined as the product of the half life and the illuminating power in the plane of the plate, and is stated in $\mu J.cm^{-2}$. Furthermore, the xerographic method can be used to determine the maximum potential acceptance in volt, the time taken to charge the recording materials to −500 volt using a corona voltage of −8.5 kV at a distance of 10 mm, the decrease in potential in the dark in the course of 20 seconds, and the total photoinduced decrease in potential, in %, for an incident energy of 1 $mJ.cm^{-2}$.

EXAMPLE 1

55 parts of a copolymer containing 70% of styrene, 6% of maleic anhydride and 24% of acrylic acid and having a mean molecular weight $\overline{M}_w$ of about 2,000, 45 parts of 2-(N,N-diethylaminophenyl)-6-methoxy-1,2,3-benzotriazole, 0.6 part of methyl violet (C.I. 42535) and 5 parts of tris(dipivalomethanato)-europium ($Eu(DPM)_3$; $C_{33}H_{57}EuO_6$) are dissolved in a mixture of tetrahydrofuran and ethyl acetate, the solution is applied onto an electrolytically roughened and subsequently anodized aluminum sheet of 0.15 mm thickness, which constitutes the electrically conductive base, the solvent is evaporated off in the air and drying is carried out for 30 minutes at 85° C., the resulting dry layer being 4 $\mu m$ thick. The xerographic test gives a half-value photosensitivity of 20.7 $\mu J.cm^{-2}$.

COMPARATIVE EXAMPLE 1

The procedure described in Example 1 is followed, except that the addition of tris(dipivalomethanato)-europium is dispensed with. The measured half-value photosensitivity is 35.4 $\mu J.cm^{-2}$.

COMPARATIVE EXAMPLE 2

The procedure described in Example 1 is followed, except that, instead of the tris(dipivalomethanato)-europium, the same amount of pure dipivalomethane ($C_{11}H_{20}O_2$) is used. The half-value photosensitivity is 29.5 $\mu J.cm^{-2}$.

COMPARATIVE EXAMPLE 3

The procedure described in Example 1 is followed, except that, instead of the tris(dipivalomethanato)-europium, the same amount of europium perchlorate ($Eu(ClO_4)_3$) (dissolved beforehand in a little water) is used. The measured half-value photosensitivity is 34.7 $\mu J.cm^{-2}$.

EXAMPLES 2 AND 3

The procedure described in Example 1 is followed, except that the tris(dipivalomethanato)-europium is replaced by tris(1,1,1,2,2,3,3-heptafluoro-7,7-dimethyloctane-4,6-dionato)-holmium ($Ho(FOD)_3$, $C_{30}H_{30}F_{21}HoO_6$, Example 2), or tris(dipivalomethanato)-praseodymium ($Pr(DPM)_3$, $C_{33}H_{57}PrO_6$, Example 3). The half-value photosensitivities are 21.6 and 16.5 $\mu J.cm^{-2}$.

EXAMPLE 4

60 parts of a copolymer containing 80% of styrene and 20% of acrylic acid and having a mean molecular weight of 1,600, 36 parts of p-diethylaminobenzaldehyde diphenylhydrazone, 1 part of rhodamine 6 G (C.I. 45160) and 8 parts of tris(dipivalomethanato)-praseodymium are dissolved in a 1:1 mixture of tetrahydrofuran and methylglycol and the solution is applied onto an aluminum sheet treated with a fine brush, the resulting dried layer being 5.5 $\mu m$ thick. The half-value photosensitivity of this electrophotographic recording material is measured as 10.8 $\mu J.cm^{-2}$.

COMPARATIVE EXAMPLE 4

The procedure described in Example 4 is followed, except that the tris(dipivalomethanato)-praseodymium is omitted. The half-value photosensitivity in this case is 16.2 $\mu J.cm^{-2}$.

EXAMPLE 5

50 parts of a copolymer containing 60% of styrene and 40% of monomethyl maleate and having a mean molecular weight $\overline{M}_w$ of 10,000, 50 parts of 2-(4'-diethylaminophenyl)-1,2,3-benzotriazole, 0.2 part of crystal violet (C.I. 42555) and 4 parts of tris(dipivalomethanato)-europium are applied, from a 5% strength solution in tetrahydrofuran, onto an electrolytically roughened and anodized aluminum foil of 0.15 mm thickness to give a layer which is about 4 μm thick when dry.

This printing plate is charged by means of a high-voltage corona and then exposed imagewise in a camera for 12 seconds. The plate is then developed with a powder toner, which is baked at 160° C. to give an abrasion-resistant surface. The non-toned area of the layer is washed off with a mixture of 0.5% of sodium carbonate, 25% of isopropanol and 74.5% of water, the aluminum surface being bared by this procedure. The solutions are applied onto the layer by brushing with a cottonwall ball. The differentiation between hydrophilic and oleophilic areas, which is desirable in offset printing, is obtained, the surface of the base constituting the hydrophilic areas.

After treatment with the alkaline liquid, the printing plate is washed with water, and the hydrophilic character of the base surface is further increased by wiping it over with dilute phosphoric acid solution. The plate is inked with a fatty ink and then used for printing in a conventional manner in an offset printing press.

EXAMPLE 6 AND COMPARATIVE EXAMPLE 5

55 parts of a copolymer containing 55% of styrene, 30% of acrylic acid and 15% of maleic anhydride and having a mean molecular weight $M_w$ of 35,000, 45 parts of 2-(N,N-diethylaminophenyl)-1,2,3-benzotriazole, 0.6 part of methyl violet (C.I. 42535) and 6 parts of tris(-dipivalomethanato)-praseodymium are dissolved in a mixture of tetrahydrofuran and methylglycol acetate, and the solution is applied onto an aluminum sheet treated with a fine brush, the resulting layer being 3.5 μm thick when dry. The comparative layer 5 is prepared as described in Example 6, but without the tris(-dipivalomethanato)-praseodymium.

Using the xerographic method, the following characteristics were measured on the two layers (Comparative Example in brackets):

(a) Time taken for charging to −500 V (−8.5 kV, 10 mm): 2.1 s (2.2 s)
(b) Maximum potential acceptance: 1300 V (1100 V)
(c) Decrease in potential in the dark (20 s, −600 V): 11% (16%)
(d) Photoinduced decrease in potential (1 mJ.cm$^{-2}$): 88% (79%)

EXAMPLE 7 AND COMPARATIVE EXAMPLE 6

A layer comprising 60 parts of a chlorinated perylene-3.4:9,10-tetracarboxylic acid diimide bisbenzimidazole with a chlorine content of about 38% and 50 parts of a commercial copolymer of vinyl chloride, acrylic acid and a maleic acid diester is applied, as a charge carrier-producing layer, in a thickness of about 0.55 μm, onto a polyethylene terephthalate film provided, by vapor deposition, with a conductive aluminum layer of about 300 Å thickness.

A charge-transporting layer comprising 45 parts of a commercial polycarbonate binder having a melting range of from 220° to 230° C., 10 parts of a polyester having an acid number of about 40 and a molecular weight of about 4,500, 40 parts of p-diethylaminobenzaldehyde diphenylhydrazone and 4 parts of tris(-dipivalomethanato)-praseodymium is applied, from a solution in ethyl acetate, onto the above charge carrier-producing layer, the solvent is evaporated off in the air and drying is carried out for 30 minutes at 80° C., the resulting dry layer being 12 μm thick.

The half-value photosensitivity determined for this layer is 2.35 μJ.cm$^{-2}$. The same layer without tris(-dipivalomethanato)-praseodymium has a half-value photosensitivity of about 4.8 μJ.cm$^{-2}$.

If the layer of Example 7 is used as a copying film in a commercial copier employing a dry toner, a large number of high-quality copies can be obtained.

We claim:

1. An electrophotographic recording material which comprises an electrically conductive base and, applied on this, an organic photoconductor layer containing one or more binders, one or more charge carrier-producing compounds or sensitizers, one or more charge carrier-transporting compounds and, in addition, from 0.5 to 30% by weight, based on the amount of binder, of a metal-1,3-diketone complex.

2. An electrophotographic recording material as defined in claim 1, wherein the 1,3-diketone complex is present in an amount of from 3 to 15% by weight, based on the binder.

3. An electrophotographic recording material as defined in claim 1, wherein the metal-1,3-diketone complex is of the formula

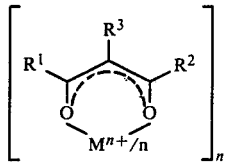

where $R^1$ and $R^2$ are identical or different and are each an unsubstituted or substituted alkyl, cycloalkyl, phenyl, naphthyl, biphenyl or 5-membered or 6-membered heterocyclic radical, $R^3$ is hydrogen or an unsubstituted or substituted alkyl or phenyl radical, M is an element of atomic number 21, 39 or 57–71, and n is 3 or, where M is cerium (atomic number 58), may furthermore be 4.

4. An electrophotographic recording material as defined in claim 1, wherein the metal-1,3-diketone complex is of the formula

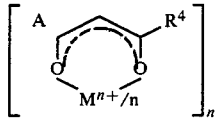

where A is an unsaturated or saturated 5-membered or 6-membered carbon ring which is unsubstituted or substituted and may be bridged by alkylene groups, $R^4$ is an unsubstituted or substituted alkyl or cycloalkyl radical, M is an element of atomic number 21, 39 or 57–71, and n is 3 or, where M is cerium (atomic number 58), may furthermore be 4.

5. An electrophotographic recording material as defined in claim 1, wherein the 1,3-diketone complex present is tris(dipivalomethanato)-europium.

6. An electrophotographic recording material as claimed in claim 1, wherein the 1,3-diketone complex present is tris(dipivalomethanato)-praseodymium.

7. An electrophotographic recording material as defined in claim 1, wherein the photoconductor layer is a double layer consisting of a layer which contains charge carrier-producing compounds and a binder-containing layer which contains charge carrier-transporting compounds and from 0.5 to 30% by weight, based on the binder present in this layer, of a metal-1,3-diketone complex.

8. An electrophotographic recording material for the production of electrophotographic printing plates, as defined in claim 1, which comprises a single photosemiconducting layer which is applied on a 0.08–0.6 mm thick base suitable for printing plates and contains (a) one or more binders (b) one or more charge carrier-transporting compounds, (c) one or more dyes as sensitizers and (d) one or more metal-1,3-diketone complexes, with or without (e) further additives.

9. A recording material as defined in claim 8, wherein the binder is soluble in basic aqueous or aqueous-alcoholic solvents.

10. A recording material as defined in claim 8, wherein the binder is a copolymer of styrene, maleic anhydride and acrylic and/or methacrylic acid, the copolymer containing from 5 to 50% by weight of maleic anhydride groups as copolymerized units and from 5 to 35% by weight of acrylic and/or methacrylic acid groups as copolymerized units.

* * * * *